US008253655B2

(12) United States Patent
Yu et al.

(10) Patent No.: US 8,253,655 B2
(45) Date of Patent: Aug. 28, 2012

(54) COMMON-VOLTAGE COMPENSATION CIRCUIT AND COMPENSATION METHOD FOR USE IN A LIQUID CRYSTAL DISPLAY

(75) Inventors: Hui-Lung Yu, Hsin-Chu (TW); Chih-Yuan Chien, Hsin-Chu (TW); Ming-Yen Lin, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 485 days.

(21) Appl. No.: 12/617,677

(22) Filed: Nov. 12, 2009

(65) Prior Publication Data

US 2010/0277399 A1 Nov. 4, 2010

(30) Foreign Application Priority Data

May 4, 2009 (TW) ..... 98114681 A

(51) Int. Cl.
*G09G 3/20* (2006.01)

(52) U.S. Cl. ..... 345/58; 345/94; 345/104

(58) Field of Classification Search ..... 345/58, 345/53, 94, 104
See application file for complete search history.

(56) References Cited

U.S. PATENT DOCUMENTS 5,442,370 A 8/1995 Yamazaki
5,818,402 A 10/1998 Park
5,926,157 A 7/1999 Moon
2006/0170640 A1* 8/2006 Okuno ..... 345/98
2006/0244704 A1* 11/2006 JaeHun ..... 345/92
2009/0015528 A1* 1/2009 Sheu ..... 345/87
2009/0040203 A1* 2/2009 Kim et al. ..... 345/204

* cited by examiner

*Primary Examiner* — Adam R Giesy
(74) *Attorney, Agent, or Firm* — Winston Hsu; Scott Margo

(57) ABSTRACT

A common-voltage compensation circuit functions to provide a crosstalk interference suppressing mechanism for use in a liquid crystal display having a liquid-crystal capacitor and a storage capacitor. The compensation circuit includes a buffer for receiving a preliminary common voltage, a current/voltage converter, a high-pass filter and a ripple-voltage inverter. The current/voltage converter is utilized for generating a liquid-crystal capacitor common voltage furnished to the liquid-crystal capacitor according to an output current of the buffer. The high-pass filter performs a high-pass filtering operation on the liquid-crystal capacitor common voltage for extracting a ripple voltage. The ripple-voltage inverter is employed to generate a storage capacitor common voltage furnished to the storage capacitor through performing an inverting operation on the ripple voltage based on the preliminary common voltage. The ripple voltage of the storage capacitor common voltage has a phase opposite to that of the liquid-crystal capacitor common voltage for suppressing crosstalk interference.

20 Claims, 4 Drawing Sheets

COMMON-VOLTAGE COMPENSATION CIRCUIT AND COMPENSATION METHOD FOR USE IN A LIQUID CRYSTAL DISPLAY

BACKGROUND OF THE INVENTION

1. Field of the Invention

The present invention relates to a common-voltage compensation circuit and compensation method, and more particularly, to a common-voltage compensation circuit and compensation method for use in a liquid crystal display so as to suppress crosstalk interference.

2. Description of the Prior Art

Along with the advantages of thin appearance, low power consumption, and low radiation, liquid crystal displays have been widely applied in various electronic products for panel displaying. The operation of a liquid crystal display is featured by varying voltage drops between opposite sides of a liquid crystal layer for twisting the angles of the liquid crystal molecules in the liquid crystal layer so that the transmittance of the liquid crystal layer can be controlled for illustrating images with the aid of the light source provided by a backlight module.

It is well known that the polarity of voltage drop across opposite sides of the liquid crystal layer should be inverted periodically for protecting the liquid crystal layer from causing permanent deterioration due to polarization, and also for reducing image sticking effect on the liquid crystal display. Accordingly, various inversion operations, such as frame-inversion driving operations, line-inversion driving operations, pixel-inversion driving operations and dot-inversion driving operations, are developed to drive the liquid crystal display for improving image display performance.

FIG. 1 is a circuit diagram schematically showing a prior-art liquid crystal display 100. The liquid crystal display 100 comprises a plurality of data lines 110, a plurality of gate lines 120, a plurality of pixel units 130 and a common voltage generator 190. As shown in FIG. 1, for ease of explanation, the liquid crystal display 100 illustrates only a data line DLi, a gate line GLj and a pixel unit Pij. The pixel unit Pij includes a data switch 135, a liquid-crystal capacitor Clc and a storage capacitor Cst. The data line DLi is employed to deliver a data signal SDi and the gate line GLj is employed to deliver a gate signal SGj. The data switch 135 makes use of the data signal SGj for controlling a writing operation of the data signal SDi so as to generate a desired pixel voltage Vij. The common voltage generator 190 is utilized for providing a common voltage Vcom furnished to a common electrode COM via a conductive line. It is well known that parasitic capacitor Cd exists between the data line DLi and the common electrode COM and, further, parasitic capacitor Cg exists between the gate line GLj and the common electrode COM. For that reason, both the voltage changes of the data signal SDi and the gate signal SGj have an effect on the common voltage Vcom at the common electrode COM. In order to suppress the voltage variation of the common voltage Vcom caused by the data signal SDi and the gate signal SGj via the parasitic capacitors Cd and Cg, an external capacitor Cext is commonly installed for stabilizing the common voltage Vcom.

FIG. 2 is a schematic diagram illustrating a display image 200 of the liquid crystal display 100 shown in FIG. 1. Regarding the exemplified display shown in FIG. 2, the display image 200 can be sectioned into a first image area 210, a second image area 220, a third image area 230 and a fourth image area 240. The first image area 210, the second image area 220 and the fourth image area 240 have an image output with a first brightness in response to a first data signal. On the other hand, the third image area 230 has an image output with a second brightness in response to a second data signal different from the first data signal. Accordingly, the second brightness is different from the first brightness. In view of that, the first image area 210, the second image area 220 and the fourth image area 240 are supposed to have the same display brightness. Since the liquid crystal display 100 illustrates images based on the aforementioned inversion driving operations, the voltage polarity switching of the second data signal is able to affect the common voltage Vcom received by the pixel units 130 of the second image area 220 via the parasitic capacitor Cd while displaying the second image area 220 and the third image area 230. Consequently, the display brightness of the second image area 220 is actually different from that of the first image area 210 and the fourth image area 240, which is known as the crosstalk interference phenomenon of the liquid crystal display 100. That is, the display quality of the liquid crystal display 100 may be degraded due to an occurrence of image brightness distortion caused by crosstalk interference regarding the inversion driving operations.

SUMMARY OF THE INVENTION

In accordance with one embodiment of the present invention, a common-voltage compensation circuit for use in a liquid crystal display having a liquid-crystal capacitor and a storage capacitor for suppressing crosstalk interference is provided. The common-voltage compensation circuit comprises a buffer, a current/voltage converter, a high-pass filter, and a ripple-voltage inverter. The buffer is utilized for receiving a preliminary common voltage. The buffer drives an output current according to the preliminary common voltage. The current/voltage converter, electrically connected to the buffer, is utilized for generating a liquid-crystal capacitor common voltage furnished to the liquid-crystal capacitor according to the output current. The high-pass filter, electrically connected to the current/voltage converter, is employed to perform a high-pass filtering operation on the liquid-crystal capacitor common voltage for extracting a first ripple voltage. The ripple-voltage inverter, electrically connected to the high-pass filter, is employed to perform an inverting operation on the first ripple voltage based on the preliminary common voltage for generating a storage capacitor common voltage having a second ripple voltage with a phase opposite to the first ripple voltage. The storage capacitor common voltage is furnished to the storage capacitor.

In accordance with another embodiment of the present invention, a liquid crystal display having a crosstalk interference suppressing mechanism is provided. The liquid crystal display comprises a data line, a gate line, a pixel unit, and a common-voltage compensation circuit. The data line is utilized for delivering a data signal. The gate line is utilized for delivering a gate signal. The pixel unit comprises a liquid-crystal capacitor, a storage capacitor and a data switch. The liquid-crystal capacitor comprises a first end and a second end. The second end of the liquid-crystal capacitor is employed to receive a liquid-crystal capacitor common voltage. The storage capacitor comprises a first end and a second end. The second end of the storage capacitor is employed to receive a storage capacitor common voltage. The data switch, electrically connected to the data line and the gate line, is utilized for controlling a writing operation of the data signal into the first ends of the liquid-crystal capacitor and the storage capacitor according to the gate signal. The common-voltage compensation circuit, electrically connected to the liquid-crystal capacitor and the storage capacitor, is utilized for converting a preliminary common voltage into the liquid-crystal capacitor common voltage and the storage capacitor common voltage. The phase of the second ripple voltage is opposite to that of the first ripple voltage.

The present invention further provides a common-voltage compensation method for use in a liquid crystal display having a liquid-crystal capacitor and a storage capacitor. The common-voltage compensation method comprises generating a liquid-crystal capacitor common voltage according to a preliminary common voltage, furnishing the liquid-crystal capacitor common voltage to the liquid-crystal capacitor, performing a high-pass filtering operation on the liquid-crystal capacitor common voltage for extracting a first ripple voltage, performing an inverting operation on the first ripple voltage based on the preliminary common voltage for generating a storage capacitor common voltage having a second ripple voltage with a phase opposite to the first ripple voltage, and furnishing the storage capacitor common voltage to the storage capacitor.

These and other objectives of the present invention will no doubt become obvious to those of ordinary skill in the art after reading the following detailed description of the preferred embodiment that is illustrated in the various figures and drawings.

DETAILED DESCRIPTION

Hereinafter, preferred embodiments of the present invention will be described in detail with reference to the accompanying drawings. Here, it is to be noted that the present invention is not limited thereto. Furthermore, the step serial numbers regarding the common-voltage compensation method are not meant thereto limit the operating sequence, and any rearrangement of the operating sequence for achieving same functionality is still within the spirit and scope of the invention.

Figure 1:
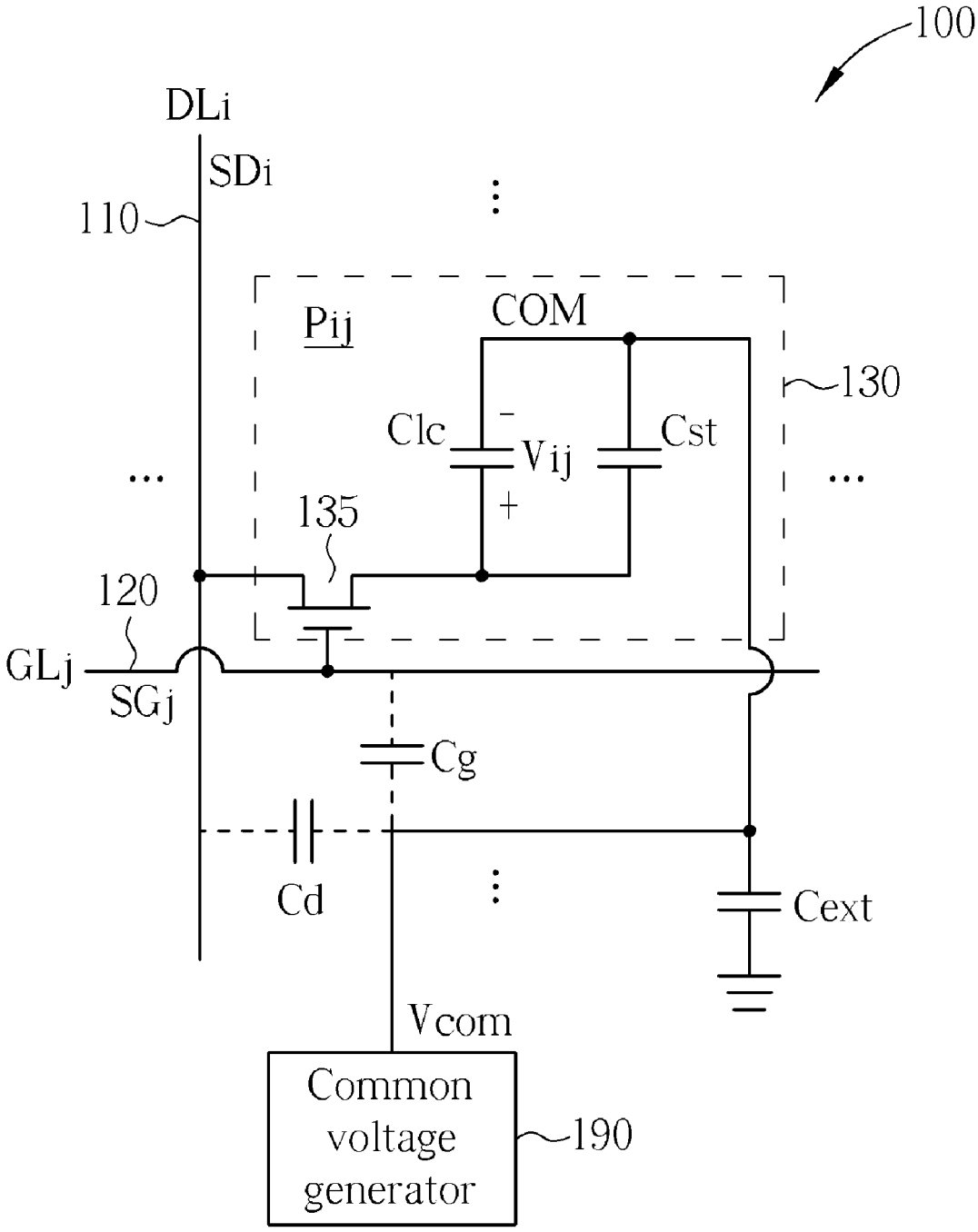
FIG. 1 PRIOR ART
FIG. 1 is a circuit diagram schematically showing a prior-art liquid crystal display.
Figure 2:
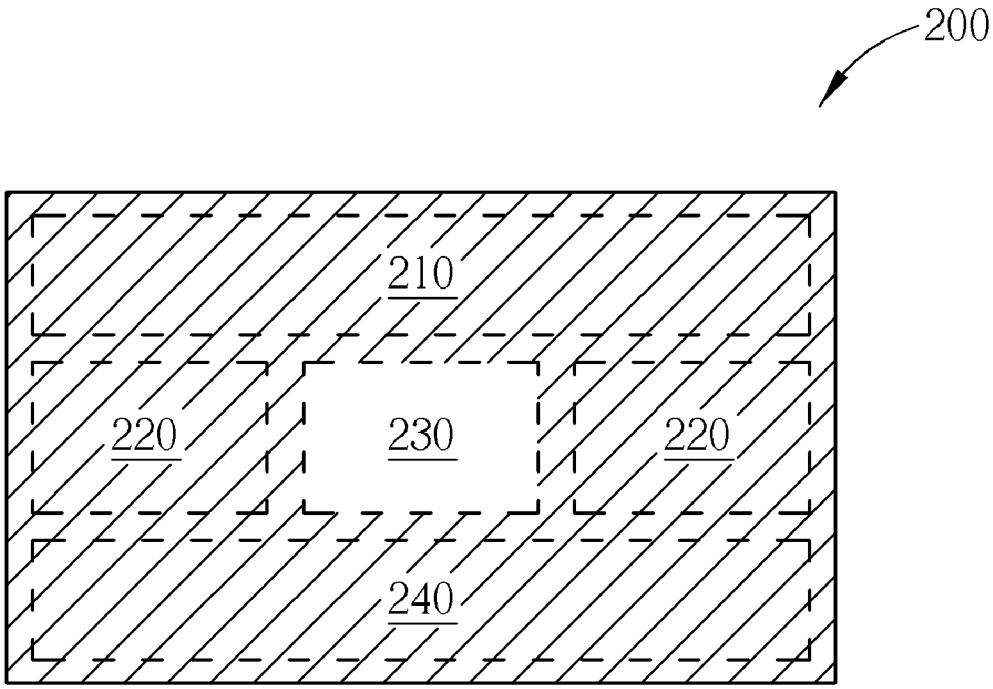
FIG. 2 PRIOR ART
FIG. 2 is a schematic diagram illustrating a display image of the liquid crystal display shown in FIG. 1.
Figure 3:
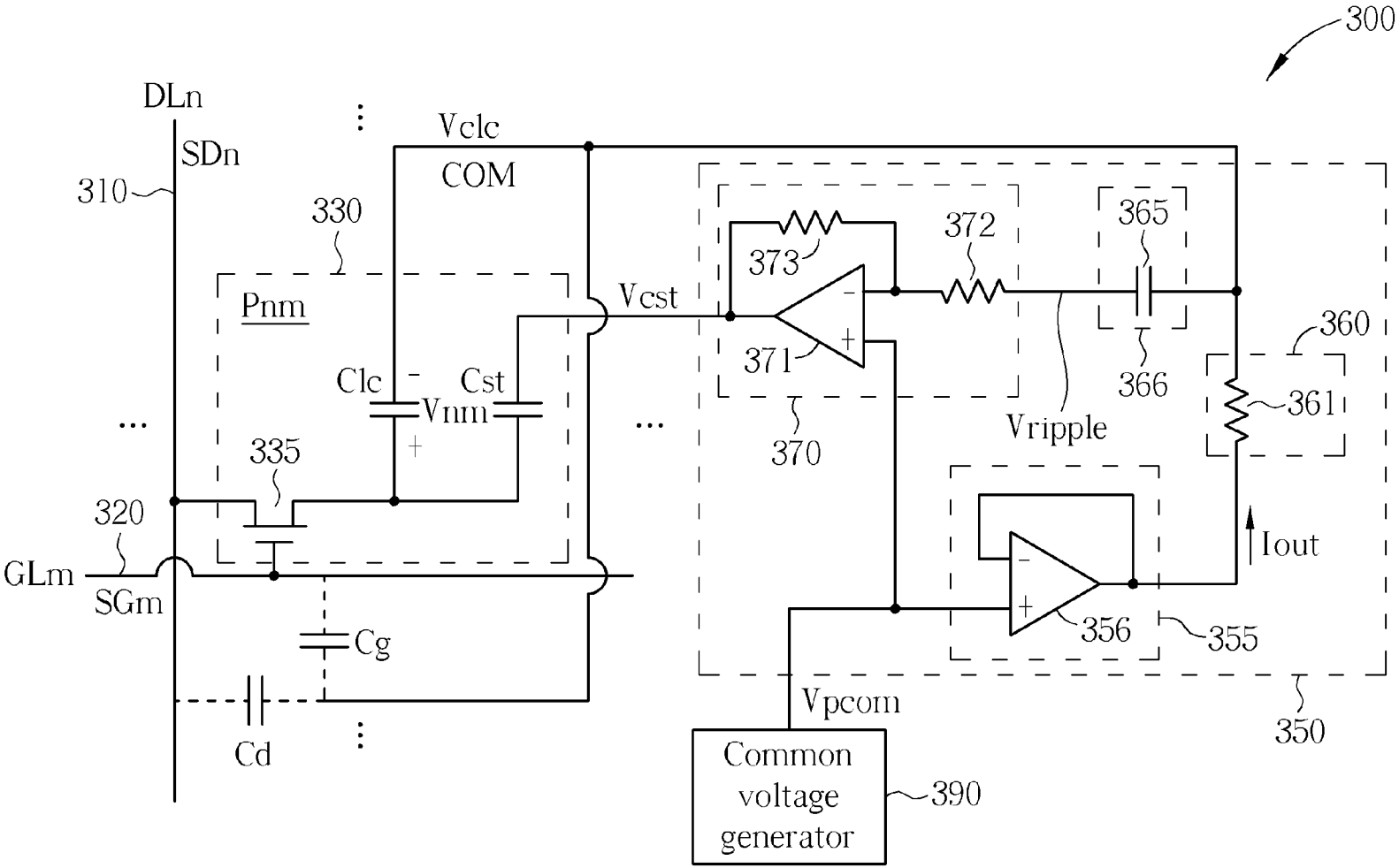
FIG. 3 is a circuit diagram schematically showing a liquid crystal display in accordance with a preferred embodiment of the present invention.

FIG. 3 is a circuit diagram schematically showing a liquid crystal display 300 in accordance with a preferred embodiment of the present invention. The liquid crystal display 300 comprises a plurality of data lines 310, a plurality of gate lines 320, a plurality of pixel units 330, a common-voltage compensation circuit 350 and a common voltage generator 390. As shown in FIG. 3, for ease of explanation, the liquid crystal display 300 illustrates only a data line DLn, a gate line GLm and a pixel unit Pnm. The pixel unit Pnm includes a data switch 335, a liquid-crystal capacitor Clc and a storage capacitor Cst. The data switch 335 can be a thin film transistor (TFT) or a metal oxide semiconductor (MOS) field effect transistor. The data line DLn is employed to deliver a data signal SDn and the gate line GLm is employed to deliver a gate signal SGm. The data switch 335 makes use of the data signal SGm for controlling a writing operation of the data signal SDn so as to generate a desired pixel voltage Vnm. The common voltage generator 390 is utilized for providing a preliminary common voltage Vpcom furnished to the common-voltage compensation circuit 350 via a conductive line. Besides, as aforementioned, parasitic capacitor Cd exists between the data line DLn and the common electrode COM and parasitic capacitor Cg exists between the gate line GLm and the common electrode COM.

The common-voltage compensation circuit 350 comprises a buffer 355, a current/voltage converter 360, a high-pass filter 365 and a ripple-voltage inverter 370. The buffer 355 is used to receive the preliminary common voltage Vpcom and drives an output current Iout according to the preliminary common voltage Vpcom. The current/voltage converter 360, electrically connected to the buffer 355, is utilized for generating a liquid-crystal capacitor common voltage Vclc according to the output current Iout. The liquid-crystal capacitor common voltage Vclc is forwarded to the common electrode COM of the liquid-crystal capacitor Clc. The high-pass filter 365, electrically connected between the current/voltage converter 360 and the ripple-voltage inverter 370, performs a high-pass filtering operation on the liquid-crystal capacitor common voltage Vclc for extracting a first ripple voltage Vripple furnished to the ripple-voltage inverter 370. The ripple-voltage inverter 370, electrically connected between the high-pass filter 365 and the storage capacitor Cst, is employed to perform an inverting operation on the first ripple voltage Vripple based on the preliminary common voltage Vpcom for generating a storage capacitor common voltage Vcst having a second ripple voltage. The phase of the second ripple voltage is opposite to that of the first ripple voltage Vripple. The storage capacitor common voltage Vcst is forwarded to the storage capacitor Cst. With the aforementioned functionalities in mind, although the voltage polarity switching of the data signal SDn and the gate signal SGm is able to affect the first ripple voltage Vripple of the liquid-crystal capacitor common voltage Vclc via the parasitic capacitors Cd, Cg while performing inversion driving operations, the voltage variation of the liquid-crystal capacitor common voltage Vclc caused by crosstalk interference can be compensated with the aid of the storage capacitor common voltage Vcst in that the phase of the second ripple voltage is opposite to that of the first ripple voltage Vripple. That is, the effect of crosstalk interference can be suppressed so as to improve image display quality. Besides, the external capacitor Cext installed in the prior-art liquid crystal display 100 for stabilizing the common voltage Vcom can be omitted to bring the cost down.

In the preferred embodiment shown in FIG. 3, the buffer 355 comprises a first operational amplifier 356, the current/voltage converter 360 comprises a resistor 361, the high-pass filter 365 comprises a capacitor 366, the ripple-voltage inverter 370 comprises a second operational amplifier 371, a first resistor 372 and a second resistor 373. The first operational amplifier 356 includes a non-inverting input end for receiving the preliminary common voltage Vpcom, an output end electrically connected to the resistor 361, and an inverting input end electrically connected to the output end. The output current Iout flowing through the resistor 361 is provided from the output end of the first operational amplifier 356. The second operational amplifier 371 includes a non-inverting input end for receiving the preliminary common voltage Vpcom, an output end for outputting the storage capacitor common voltage Vcst, and an inverting input end electrically connected to a connection node of the first resistor 372 and the second resistor 373. The first resistor 372 is electrically connected between the capacitor 366 and the inverting input end of the second operational amplifier 371. The second resistor 373 is electrically connected between the inverting input end and the output end of the second operational amplifier 371. In one embodiment, the resistance ratio of the second resistor 373 to the first resistor 372 is determined according to the panel size of the liquid crystal display 300. In another embodiment, the resistance ratio of the second resistor 373 to the first resistor 372 is determined according to the capacitance ratio of the storage capacitor Cst to the liquid-crystal capacitor Clc.

Figure 4:
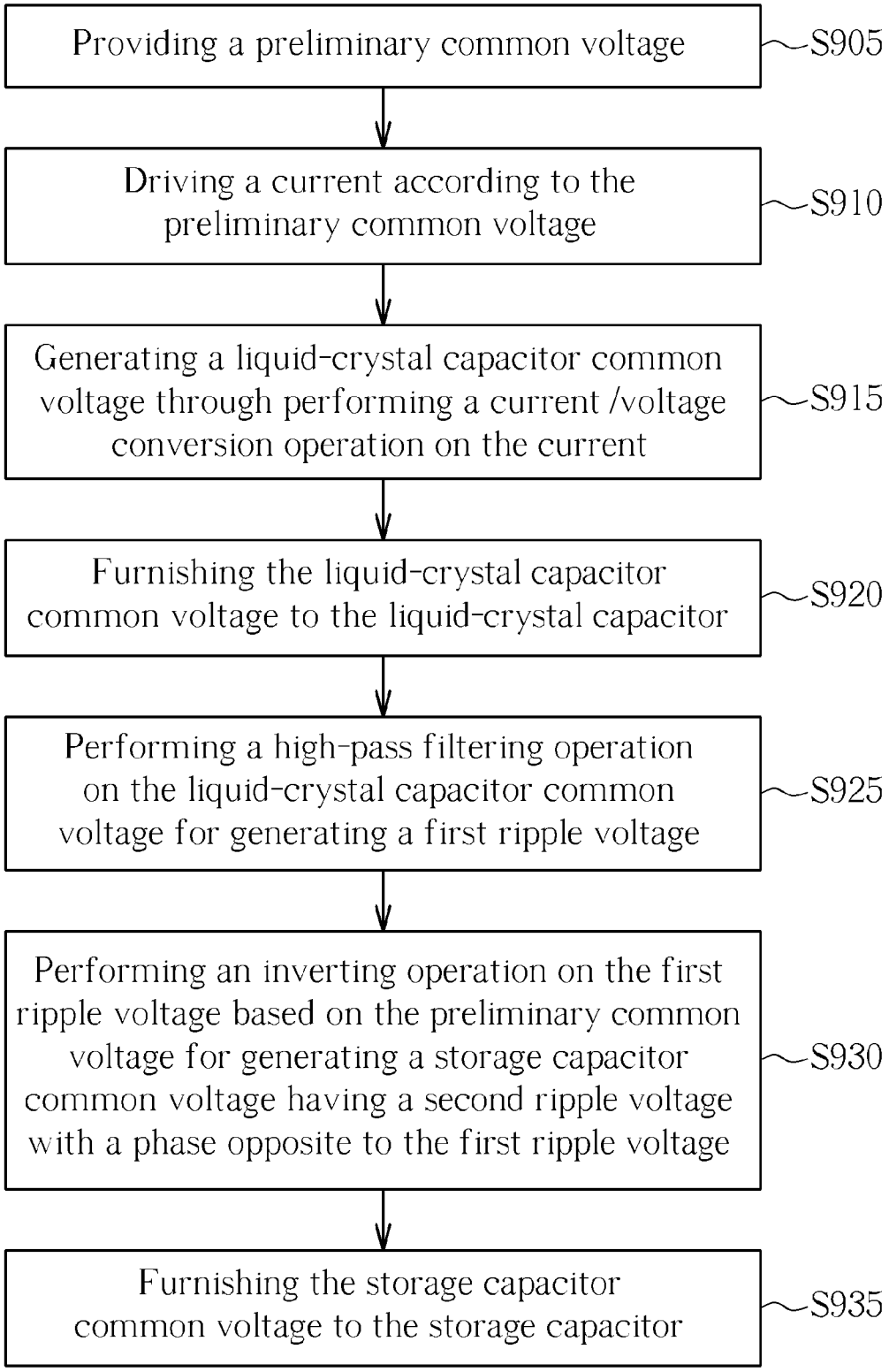
FIG. 4 is a flowchart depicting a common-voltage compensation method for use in a liquid crystal display having a liquid-crystal capacitor and a storage capacitor according to the present invention.

FIG. 4 is a flowchart depicting a common-voltage compensation method for use in a liquid crystal display having a liquid-crystal capacitor and a storage capacitor according to the present invention. As shown in FIG. 4, the flow 900 of the common-voltage compensation method comprises the following steps:

Step S905: providing a preliminary common voltage;

Step S910: driving a current according to the preliminary common voltage;

Step S915: generating a liquid-crystal capacitor common voltage through performing a current/voltage conversion operation on the current;

Step S920: furnishing the liquid-crystal capacitor common voltage to the liquid-crystal capacitor;

Step S925: performing a high-pass filtering operation on the liquid-crystal capacitor common voltage for extracting a first ripple voltage;

Step S930: performing an inverting operation on the first ripple voltage based on the preliminary common voltage for generating a storage capacitor common voltage having a second ripple voltage with a phase opposite to the first ripple voltage; and Step S935: furnishing the storage capacitor common voltage to the storage capacitor.

Regarding the flow 900 of the common-voltage compensation method, the peak-to-peak value ratio of the second ripple voltage to the first ripple voltage can be determined according to the panel size of the liquid crystal display or according to the capacitance ratio of the storage capacitor to the liquid-crystal capacitor. Based on the aforementioned flow 900, it is obvious that the common-voltage compensation method of the present invention makes use of the preliminary common voltage for generating the liquid-crystal capacitor common voltage and the storage capacitor common voltage having ripple voltages opposite to each other so as to compensate common voltage variation caused by crosstalk interference. For that reason, the effect of crosstalk interference can be suppressed for enhancing image display quality of the liquid crystal display.

In summary, the present invention provides a common-voltage compensation circuit and compensation method for use in a liquid crystal display, which generates the liquid-crystal capacitor common voltage and the storage capacitor common voltage having ripple voltages opposite to each other for compensating common voltage variation caused by crosstalk interference so that the effect of crosstalk interference can be suppressed for enhancing image display quality of the liquid crystal display.

The present invention is by no means limited to the embodiments as described above by referring to the accompanying drawings, which may be modified and altered in a variety of different ways without departing from the scope of the present invention. Thus, it should be understood by those skilled in the art that various modifications, combinations, sub-combinations and alternations might occur depending on design requirements and other factors insofar as they are within the scope of the appended claims or the equivalents thereof.

What is claimed is:

1. A common-voltage compensation circuit for use in a liquid crystal display having a liquid-crystal capacitor and a storage capacitor, the common-voltage compensation circuit comprising:

a buffer for receiving a preliminary common voltage, the buffer driving an output current according to the preliminary common voltage;

a current/voltage converter, electrically connected to the buffer, for generating a liquid-crystal capacitor common voltage furnished to the liquid-crystal capacitor according to the output current;

a high-pass filter, electrically connected to the current/voltage converter, for performing a high-pass filtering operation on the liquid-crystal capacitor common voltage for extracting a first ripple voltage; and a ripple-voltage inverter, electrically connected to the high-pass filter, for performing an inverting operation on the first ripple voltage based on the preliminary common voltage for generating a storage capacitor common voltage having a second ripple voltage with a phase opposite to the first ripple voltage, the storage capacitor common voltage being furnished to the storage capacitor.

2. The common-voltage compensation circuit of claim 1, wherein the buffer comprises an operational amplifier, the operational amplifier comprising:

a non-inverting input end for receiving the preliminary common voltage;

an output end, electrically connected to the current/voltage converter, for outputting the output current; and an inverting input end electrically connected to the output end.

3. The common-voltage compensation circuit of claim 1, wherein the current/voltage converter comprises a resistor electrically connected between the buffer and the high-pass filter.

4. The common-voltage compensation circuit of claim 1, wherein the high-pass filter comprises a capacitor electrically connected between the current/voltage converter and the ripple-voltage inverter.

5. The common-voltage compensation circuit of claim 1, wherein the ripple-voltage inverter comprises:

an operational amplifier comprising a non-inverting input end for receiving the preliminary common voltage, an output end for outputting the storage capacitor common voltage, and an inverting input end;

a first resistor electrically connected between the high-pass filter and the inverting input end of the operational amplifier; and a second resistor electrically connected between the inverting input end and the output end of the operational amplifier.

6. The common-voltage compensation circuit of claim 5, wherein a resistance ratio of the second resistor to the first resistor is determined according to a panel size of the liquid crystal display.

7. The common-voltage compensation circuit of claim 5, wherein a resistance ratio of the second resistor to the first resistor is determined according to a capacitance ratio of the storage capacitor to the liquid-crystal capacitor.

8. A liquid crystal display having a crosstalk interference suppressing mechanism, the liquid crystal display comprising:

a data line for delivering a data signal;

a gate line for delivering a gate signal;

a pixel unit comprising:

a liquid-crystal capacitor comprising a first end and a second end, the second end of the liquid-crystal capacitor being employed to receive a liquid-crystal capacitor common voltage;

a storage capacitor comprising a first end and a second end, the second end of the storage capacitor being employed to receive a storage capacitor common voltage; and a data switch, electrically connected to the data line and the gate line, for controlling a writing operation of the data signal into the first ends of the liquid-crystal capacitor and the storage capacitor according to the gate signal; and a common-voltage compensation circuit, electrically connected to the liquid-crystal capacitor and the storage capacitor, for converting a preliminary common voltage into the liquid-crystal capacitor common voltage and the storage capacitor common voltage, wherein a second ripple voltage of the storage capacitor has a phase opposite to a first ripple voltage of the liquid-crystal capacitor common voltage.

9. The liquid crystal display of claim 8, wherein the common-voltage compensation circuit comprises:

a buffer for receiving the preliminary common voltage, the buffer driving an output current according to the preliminary common voltage;

a current/voltage converter, electrically connected to the buffer, for generating the liquid-crystal capacitor common voltage according to the output current;

a high-pass filter, electrically connected to the current/voltage converter, for performing a high-pass filtering operation on the liquid-crystal capacitor common voltage for extracting the first ripple voltage; and a ripple-voltage inverter, electrically connected to the high-pass filter, for performing an inverting operation on the first ripple voltage based on the preliminary common voltage for generating the storage capacitor common voltage.

10. The liquid crystal display of claim 9, wherein the buffer comprises an operational amplifier, the operational amplifier comprising:

a non-inverting input end for receiving the preliminary common voltage;

an output end, electrically connected to the current/voltage converter, for outputting the output current; and an inverting input end electrically connected to the output end.

11. The liquid crystal display of claim 9, wherein the current/voltage converter comprises a resistor electrically connected between the buffer and the high-pass filter.

12. The liquid crystal display of claim 9, wherein the high-pass filter comprises a capacitor electrically connected between the current/voltage converter and the ripple-voltage inverter.

13. The liquid crystal display of claim 9, wherein the ripple-voltage inverter comprises:

an operational amplifier comprising a non-inverting input end for receiving the preliminary common voltage, an output end for outputting the storage capacitor common voltage, and an inverting input end;

a first resistor electrically connected between the high-pass filter and the inverting input end of the operational amplifier; and a second resistor electrically connected between the inverting input end and the output end of the operational amplifier.

14. The liquid crystal display of claim 13, wherein a resistance ratio of the second resistor to the first resistor is determined according to a panel size of the liquid crystal display.

15. The liquid crystal display of claim 13, wherein a resistance ratio of the second resistor to the first resistor is determined according to a capacitance ratio of the storage capacitor to the liquid-crystal capacitor.

16. The liquid crystal display of claim 8, further comprising:

a common voltage generator, electrically connected to the common-voltage compensation circuit, for providing the preliminary common voltage.

17. A common-voltage compensation method for use in a liquid crystal display having a liquid-crystal capacitor and a storage capacitor, the common-voltage compensation method comprising:

generating a liquid-crystal capacitor common voltage according to a preliminary common voltage;

furnishing the liquid-crystal capacitor common voltage to the liquid-crystal capacitor;

performing a high-pass filtering operation on the liquid-crystal capacitor common voltage for extracting a first ripple voltage;

performing an inverting operation on the first ripple voltage based on the preliminary common voltage for generating a storage capacitor common voltage having a second ripple voltage with a phase opposite to the first ripple voltage; and furnishing the storage capacitor common voltage to the storage capacitor.

18. The common-voltage compensation method of claim 17, wherein the step of generating the liquid-crystal capacitor common voltage according to the preliminary common voltage comprises:

driving a current according to the preliminary common voltage; and generating the liquid-crystal capacitor common voltage through performing a current/voltage conversion operation on the current.

19. The common-voltage compensation method of claim 17, further comprising:

determining a peak-to-peak value ratio of the second ripple voltage to the first ripple voltage according to a panel size of the liquid crystal display.

20. The common-voltage compensation method of claim 17, further comprising:

determining a peak-to-peak value ratio of the second ripple voltage to the first ripple voltage according to a capacitance ratio of the storage capacitor to the liquid-crystal capacitor.

* * * * *